US012139809B2

(12) United States Patent
Rose et al.

(10) Patent No.: US 12,139,809 B2
(45) Date of Patent: Nov. 12, 2024

(54) ELECTROCHEMICAL TREATMENT SYSTEM

(71) Applicant: Corrdesa, LLC, Tyrone, GA (US)

(72) Inventors: Alan Rose, Newnan, GA (US); Keith Otto Legg, Peachtree City, GA (US)

(73) Assignee: Corrdesa, LLC, Tyrone, GA (US)

( * ) Notice: Subject to any disclaimer, the term of this patent is extended or adjusted under 35 U.S.C. 154(b) by 0 days.

(21) Appl. No.: 17/569,728

(22) Filed: Jan. 6, 2022

(65) Prior Publication Data

US 2022/0220628 A1 Jul. 14, 2022

Related U.S. Application Data

(60) Provisional application No. 63/136,868, filed on Jan. 13, 2021.

(51) Int. Cl.

| | |
|---|---|
| ***C25D 21/12*** | (2006.01) |
| ***C25D 5/02*** | (2006.01) |
| ***C25D 11/02*** | (2006.01) |
| ***C25D 21/04*** | (2006.01) |

(52) U.S. Cl.

CPC ..... *C25D 21/12* (2013.01); *C25D 5/02* (2013.01); *C25D 11/02* (2013.01); *C25D 21/04* (2013.01)

(58) Field of Classification Search

None

See application file for complete search history.

(56) References Cited

U.S. PATENT DOCUMENTS

| | | | | |
|---|---|---|---|---|
| 4,744,873 | A | 5/1988 | Sorenson | |
| 5,571,389 | A | 11/1996 | Kerampran | |
| 6,080,288 | A * | 6/2000 | Schwartz | C25D 1/10 204/239 |
| 6,176,992 | B1 * | 1/2001 | Talieh | C25D 5/617 257/E21.175 |
| 6,328,872 | B1 * | 12/2001 | Talieh | C25D 5/22 204/224 R |
| 6,375,823 | B1 * | 4/2002 | Matsuda | C25D 17/001 205/117 |
| 7,566,385 | B2 * | 7/2009 | Mazur | H01L 21/32115 204/239 |
| 9,982,359 | B2 * | 5/2018 | Sato | C25F 7/00 |

(Continued)

OTHER PUBLICATIONS

English translation WO2013/178959 (Year: 2013).*

(Continued)

*Primary Examiner* — Stefanie S Wittenberg

(74) *Attorney, Agent, or Firm* — Iandiorio Teska & Coleman, LLP

(57) ABSTRACT

An electrochemical treatment system includes a treatment fluid supply manifold, a fluid return manifold, and an electrode section connected to the treatment fluid supply manifold. A plurality of treatment fluid supply ports feed fluid through or across the electrode and a plurality of fluid return ports proximate the treatment fluid supply ports are connected to the fluid return manifold. A porous pad is coupled to the electrode section for contacting a substrate to be treated and receives the treatment fluid via the plurality of treatment fluid supply ports. The plurality of fluid return ports remove spent and excess treatment fluid and gases from the substrate, the surrounding air, and the porous pad.

45 Claims, 12 Drawing Sheets

(56) References Cited

U.S. PATENT DOCUMENTS

| | | | | |
|---|---|---|---|---|
| 2009/0090634 | A1* | 4/2009 | Radatz | C25D 5/38 205/206 |
| 2011/0155563 | A1* | 6/2011 | Ravkin | C25D 5/22 204/224 R |
| 2012/0031754 | A1 | 2/2012 | Shyu | |
| 2015/0184308 | A1 | 7/2015 | Dalic | |
| 2015/0211132 | A1 | 7/2015 | MacKinnon et al. | |
| 2016/0265129 | A1* | 9/2016 | Hiraoka | C25D 17/00 |
| 2017/0335479 | A1* | 11/2017 | Sato | C25D 5/06 |

OTHER PUBLICATIONS

English translation WO 2012/007520 (Year: 2012).*
English translation JP 57009894 (Year: 1982).*
Patel et al., "Micro-Texturing on Free-Form Surfaces using Flexible-Electrode Through-Mask Electrochemical Micromachining." Journal of Materials Processing Technology 282 (2020): 116644.
Written Opinion of the International Searching Authority for International Application No. PCT/US22/12099 dated Jun. 6, 2022, nine (9) pages.

* cited by examiner

ELECTROCHEMICAL TREATMENT SYSTEM

RELATED APPLICATIONS

This application claims benefit of and priority to U.S. Provisional Application Ser. No. 63/136,868 filed Jan. 13, 2021, under 35 U.S.C. §§ 119, 120, 363, 365, and 37 C.F.R. § 1.55 and § 1.78, which is incorporated herein by this reference.

This invention was made with Government support under Contract No. N68335-16-C-0449 awarded by the Department of the Navy. The Government has certain rights in the subject invention.

FIELD OF THE INVENTION

The invention relates generally to a scalable device for electrochemical treatment of a surface in numerous orientations.

BACKGROUND OF THE INVENTION

Most electrochemical treatments such as anodizing occur in the tank filled with an electrolyte. Currently, there are a number of solutions for minimizing the mess, drippage and impact of off-gases associated with the local, selective electrochemical treatment of substrates. See U.S. Pat. No. 2,108,700 incorporated herein by this reference.

Some of these solutions attempt to flow the required electrolytes through the treatment tooling and into a collection reservoir. But these solutions may fail to meet the needs of the industry as still much pre-preparation is required to layout plastics and tapes to gather and direct the flow of electrolytes back to the reservoirs, still risking the creation of spillages and doing little to reduce potential off-gases inhaled by the operator.

Other solutions attempt to flow the electrolyte through some holes in the center of the electrode and then recycle the electrolyte through a single, peripheral opening surrounding the electrode. See U.S. Pat. Nos. 9,863,056 and 5,571,389 both incorporated herein by this reference. While this particular approach might work for small treatment areas it may not be scalable to larger treatment areas as eventually the distance between the central electrode holes and the peripheral exhaust becomes too large and such larger tools will inevitably drip.

Consequently, such tools are limited to the treatment of smaller items. Attempts to treat larger items would involve unrealistically large process times, consuming costly labor time and opening up the operator to risk of repetitive strain injuries in handling the tooling for such long periods.

BRIEF SUMMARY OF THE INVENTION

For the electrochemical treatment of large articles there are many processes that employ large process tanks where the whole component for treatment is immersed. This is known as in-tank processing. However, for the manufacture of smaller articles or local repair it is desirable to have a device that can apply electrochemical treatment "out of tank", locally on a surface of any shape and orientation without creating unwanted drips and runs of the process fluids which could damage the part or create a health hazard for the operator of the device. Furthermore, it is desirable that such a device can easily be increased in scale in order to treat larger surfaces on larger articles, "out of tank" yet maintain the advantages of no drippage and reasonable overall process times.

There are some present devices that can electrochemically treat surfaces without drippage but such devices are limited to small scales, a particular weakness in their design being that they employ only a single fluid inflow and outflow. When trying to scale up such a device, there becomes a point where the outflow is at a distance too far from the inflow, and thereby not able to apply the necessary suction to maintain the advantage of non-drip without interfering with other aspects of the process. For example, if too much suction is applied to such a device, then the porous media does not receive a uniform supply of inflow fluid and cannot uniformly apply the electrochemical treatment. If not enough suction is applied, the incoming fluids will be in excess and unwanted drippage will occur.

The disclosed device, in one example, advantageously fills these needs and addresses the aforementioned deficiencies by providing, in the same electrode, a system of multiple return flow channels in conjunction with a system of multiple supply flow channels. In this way, the distances from the individual alternating supply flow ports and the individual alternating return flow ports can be engineered and optimized to ensure non-drippage performance and uniform electrochemical treatment in a timely fashion.

Consequently, an electrode of this design can be made at much larger sizes and still maintain full functionality. Employing such an electrode design with manifolded systems of supply flows and return flows is believed unique and, although such designs can range from simple to complex, it is now possible to fabricate such designs, at relatively low cost with modern machining and fabricating techniques such as additive manufacturing for example. With such a scalable electrode design, it is now possible to plate or anodize much larger components out of tank thereby avoiding the huge capital cost of an immersion tank plating or anodizing line and associated equipment.

Featured is a tool which applies an electrochemical treatment to a surface in many orientations. Fluid supply channel systems feed fluid to fluid supply ports and fluid return channel systems draw return fluids. Single or multiple electrodes each have an embedded multitude of flow channels. Also included are a porous media and electrical connections.

Preferably, the electrode contains within it, two or more, separated systems comprising multiple channels. One system of channels connects between the fluid supply and the porous media and another system of channels connects between the fluid return and the porous media. The electrode is preferably connected to one of the terminals of a current source and the surface to be treated is connected to the other terminal of the same current source. The system can then be used to electrochemically treat the surface in any orientation. By touching the surface to be treated with the porous media, an electrical circuit is completed. The supply fluid is preferably an electrolyte which flows through the system of fluid supply channels inside the electrode and into the adjacent porous media. The return flow system of channels inside the electrode are also connected to the porous media and apply a suction that draws in excess electrolyte and surrounding ambient gases thereby avoiding oversupply of the electrolyte and avoiding unwanted drippage.

Disclosed is a scalable device for electrochemical treatment of a surface in any orientation and any size.

Also possible is more than one system of fluid supply channels. This may be beneficial if components of the electrolyte composition have to remain separate until the moment of application. Also, the supply fluids could be required for certain steps in the substrate treatment, so one fluid supply system could be a rinse water for example and another fluid supply system supplied from a separate source could be a plating solution. In this way, time would be saved by avoiding a change of tool or fluid supply reservoir.

Also possible is more than one system of return fluid channels. For example one might want to withdraw a large amount of fluid and perhaps even more ambient air/environmental gas, but be limited in the size of available pumps, so rather than one large pump on one return fluid system you could have two of more smaller pumps on two of more return fluid systems. More suction might be required for larger process fluid volumes or lower viscous fluids for example.

A perimeter/surrounding flow system is possible to suck ambient gasses, not through the porous media, but immediately adjacent to it and could be used to more effectively reduce emissions of volatiles from the coating process and lowering exposures to personnel. This additional perimeter flow system could be run as suction from another pump or even a fan for improved movement of gasses or improved drying of product coating. The perimeter flow system could be worked in reverse and supplied by warm air from the pump or fan to aid drying of the treatment coating. The perimeter flow system could be worked in reverse and supplied by certain gases to form a local, inert atmosphere.

The resulting pattern or arrangement of fluid supply ports and fluid return ports on the electrode bounding surfaces may be configured in a number of different ways. One embodiment could have alternating supply ports and return ports, which may be more amenable to scaling for larger electrodes. Another example might be groups of supply ports and groups of return ports. Serpentine arrangements of supply ports and return ports, and/or spiral and double spiral arrangements.

The shape of the individual supply ports and return ports may also be different, for example, slots, circular, elliptical, rectangular. The bounding faces of the electrode do not need to be planar. The electrode can be curved to more appropriately contour with the substrate to be treated. The electrode and the surrounding tool can be manufactured from flexible materials to accommodate to the surface of curved shapes. Castellations could be used to better secure the porous media as well as bringing in the supply fluid at different depth levels in the porous media compared to the return flow which would resist the fluids short circuiting.

Also, an additional component, conductive or non-conductive may be inserted between the electrode and porous media. This could be used to better guide flow into the porous media and reduce short circuiting, and to improve and further refine flow distribution from an electrode with larger ports.

The current supply does not need to be electrically active—for example, to use the benefits of the device to rinse in a non-drip fashion.

The device may be small and light enough to be handheld or larger for use with a robot. COBOT or other machinery where the device can be moved over the component or the component can be moved over the device.

The fluid supply may be a pump, a syringe like device, a gravity fed reservoir, and/or a fan. Fluid collection may be the suction end of a pump or fan. The porous media material may be of different porosities for different fluids and processes. The supply current may be direct, alternating, pulse or pulse reverse. The electrode may be a stainless steel for anodizing. The electrode may be titanium coated with platinum, Mixed Metal Oxide (MMO), or other coatings to enhance current transfer.

The incoming and outgoing fluids may be cooled with a chiller device or heated as appropriate with a temperature-controlled, resistive heating element or thermoelectric means.

The disclosed device is believed unique when compared with other known devices and solutions because, by incorporating a plurality of systems of fluid supply channels and systems of fluid return channels integrated within the same solid electrode, fluid supply ports and fluid return ports can be arranged and placed in close proximity to each other on the faces of the electrode to enable precise control and balance of the flows into and out of the porous media, avoiding fluid drippage.

The balance of the fluid supply flows and fluid return flows can be important to the successful operation of the non-drip system and may depend on many parameters such as the flow rate, viscosity of the fluids, porosity of the porous media and of course the precise geometry of the fluid flow channel systems within the electrode. Leveraging modern engineering software tools such as multi-phase computational fluid dynamics, it is possible to design, size and optimize the precise channel system dimensions and routing in order to calculate the pump rates required for the supply flows and return flows. These pump rates can then be set into the system with the use of a pump controller.

In particular, this unique design approach enables the electrode system to be easily scaled enabling selective plating, anodizing, electrophoretic coating, electropolishing, stripping, or other electrochemical processes to be executed in a non-drip fashion on much larger components. Consequently, this removes the previous limitation that has led to large components necessarily being treated in tanks.

The disclosed device is believed unique in that by leveraging modern manufacturing techniques, it is significantly structurally different from other known devices or solutions.

A plurality of fluid supply channel systems can be integrated within the solid of the electrode enabling a uniform supply of different fluids to the porous media. The cross-section of the channels and the exit shapes can be custom designed, optimized, and vary in shape and size to ensure uniform distribution of flow delivered to the porous media. A plurality of fluid return channel systems are preferably separate from the fluid supply channel systems and yet are still integrated within the same solid electrode structure. The cross-section of the channels and the exit shapes can be custom designed, optimized, and vary in shape and size to ensure uniform collection of flow of excess fluids and ambient gases from the porous media avoiding drippage and starving of flow in the porous media.

The design approach can be thought of as arranging multiple channels systems in the solid electrode and manifolding these channels towards several individual fluid supply reservoirs and fluid return reservoirs. Another design strategy is to consider the number of channel systems required and then arrange them to gather into individual plenums that can be arranged as chamber/pillar structures and then each can be connected to the pumps for supply flow or return flow control. The advent of modern additive manufacturing techniques makes this approach possible.

So, further unique advantages are supply fluid ports and return fluid ports in the electrode that do not have to be in the same plane allowing more options to avoid short circuiting of supply fluids and return fluids, and a peripheral arrangement of openings that can be used solely for collection of noxious off-gases or supply of inerting gases or rinsing fluids or additives.

Featured is an electrochemical treatment system comprising a housing including a treatment fluid supply manifold, a fluid return manifold, and an electrode section connected to the treatment fluid supply manifold. A plurality of treatment fluid supply ports feed fluid through or across the electrode and a plurality of fluid return ports proximate the treatment fluid supply ports are connected to the fluid return manifold. A porous pad is coupled to the electrode section for contacting a substrate to be treated and receives the treatment fluid via the plurality of treatment fluid supply ports. The plurality of fluid return ports remove spent and excess treatment fluid and gases from the substrate, the surrounding air, and the porous pad.

The treatment fluid is preferably an electrolyte. The system may further include a treatment fluid reservoir coupled to the treatment fluid supply manifold via a first pump. The system may further include a return flow reservoir coupled to the fluid return manifold via a second pump. A controller automatically operates the first pump and the second pump at rates which fully disperse the treatment fluid throughout the pad while limiting leakage of treatment fluid from the pad.

The system may further include a power supply electrically interconnected between the electrode and the substrate. The treatment fluid supply manifold may include linear channels each over an array of fluid supply ports and the return manifold may include linear channels each over an array of fluid return ports. The fluid supply manifold linear channels may alternate with the return fluid manifold linear channels. The array of fluid supply ports may be a 1 by n array where n is greater than 1 and/or the return fluid ports may be in a 1 by n array where n is greater than 1. The fluid supply manifold may further include a duct interconnecting the linear channels over the array of fluid supply ports and the return fluid manifold may further include a duct interconnecting the linear channels over the array of return fluid ports.

The electrode section may further include a peripheral fluid return and the pad may be internal to the peripheral fluid return. The electrode may further include a peripheral fluid return manifold coupled to the peripheral fluid ports.

The system housing can include an internal wall separating the housing into a treatment fluid supply chamber and a return fluid chamber. The fluid supply chamber may be located between the wall and the electrode bottom section and the fluid supply ports are in communication with the fluid supply chamber. The fluid supply manifold may include the fluid supply chamber and a conduit extends from the fluid supply chamber through the wall. The fluid return manifold may include the fluid return chamber and conduits extending through the internal wall to the fluid return ports in the bottom electrode section.

The fluid supply manifold may include a first plenum and the fluid return manifold may include a second plenum nestled with the first plenum. The pad may include nonwoven fibers in a three-dimensional web.

In one system, there are first and second treatment fluid manifolds each connected to a sub plurality of treatment fluid supply ports and each connected via a pump to a different treatment fluid reservoir.

In one system, there are one or more treatment cells constructed so that each cell may be operated independently, or together with any other cell, each cell comprising an fluid supply manifold, a fluid return manifold, an electrode, and a plurality of fluid supply ports and fluid return ports. The system may be flexible, allowing the system to maintain contact with a curved surface. For example, the electrode can be made of wires, grids, meshes, fibers, conductive polymers, or other flexible materials.

Also featured is a method of electrochemically treating a substrate. The substrate contacts an electrode fitted with a porous pad, a treatment fluid is driven through supply ports in the electrode and to multiple locations of the porous pad and spent and excess treatment fluid and gases from multiple locations of the porous pad are urged through return ports in the electrode at a rate which limits treatment fluid leakage from the pad while urging the treatment fluid to fully disperse throughout the extent of the pad.

The method may include pumping the treatment fluid from a reservoir to the electrode, and pumping the spent and excess treatment fluid from the pad. The method may further include connecting a power supply between the electrode and the substrate.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
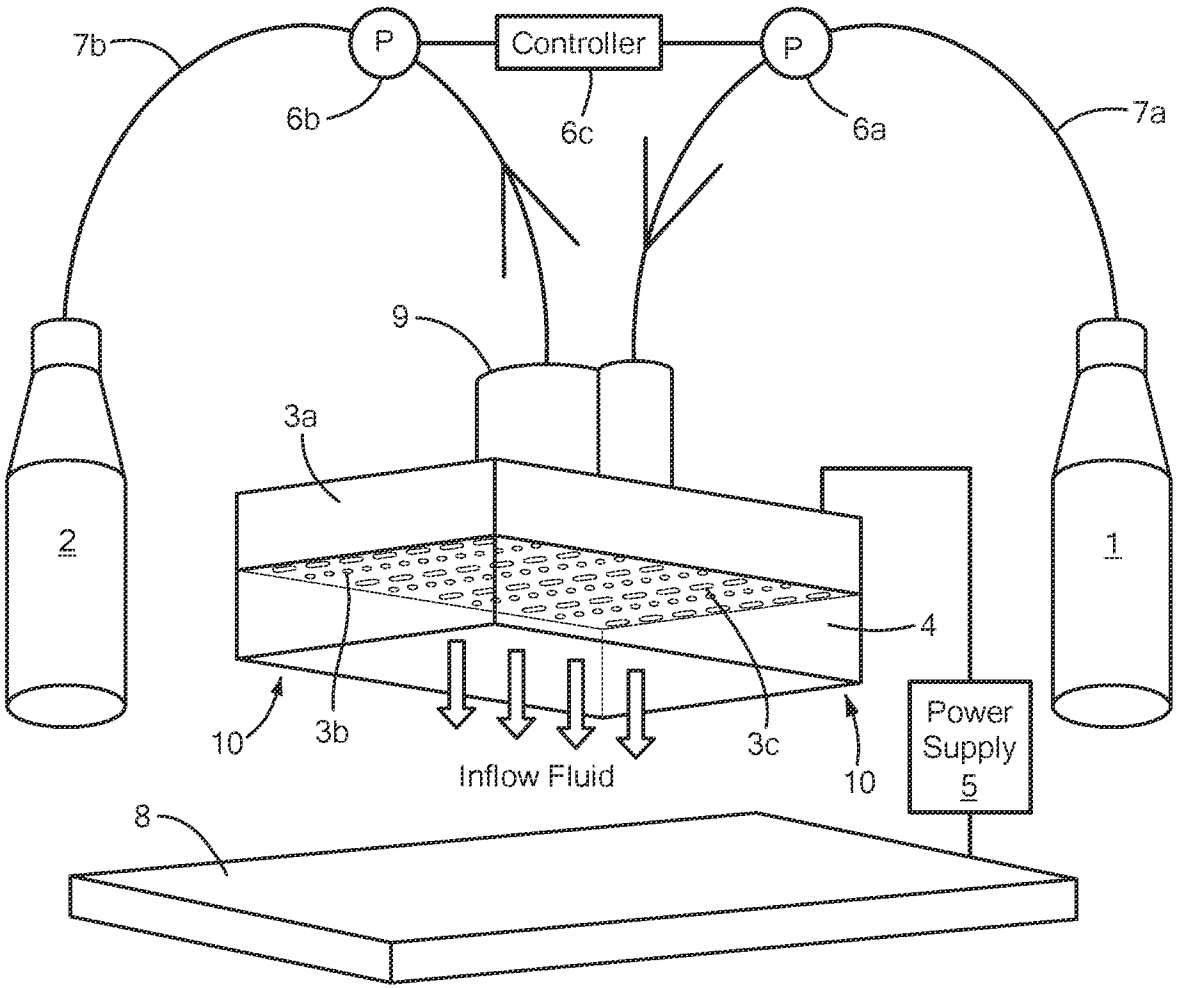
FIG. 1 is a schematic view of one particular version of the whole selective plating/anodizing system.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

The present invention is directed to scalable device for electrochemical treatment of a surface in any orientation In one version, the device of FIG. 1 includes one or more supply fluid reservoir(s) 1, one or more return fluid reservoir (s) 2, solid electrode 3*a* with an integrated plurality of supply fluid channel systems 3*b* and return flow channel systems 3*c*, porous media pad 4, a power supply 5, pumps 6*a* and 6*b*, controlled by controller 6*c*, tubing 7*c* and 7*a*. Controller 6*c* may be a microprocessor, microcontroller, computer subsystem, or the like. The supply fluid reservoir 1 is connected to a pump 6*a* via tubing 7*a*. The pump 6*a* motivates the supply fluid from the supply fluid reservoir 1 through tubing 7*a* to the supply fluid channel systems integrated into the solid electrode 3*a*. The electrode supply fluid channels exit through numerous electrolyte ports 3*b* on the face(s) of the solid electrode 3*a* adjacent to the porous pad 4 enabling fluid flow into and through the porous pad 4 towards a substrate 8 being treated. Also, adjacent to the porous media pad 4 and on the electrode surface, there are preferably numerous electrolyte suction ports 3*c* connecting to the return fluid channel systems integrated within the same solid electrode 3*a*. These return fluid channel systems are manifolded into collection point 9 on surface(s) of the solid electrode 3*a* and are then connected through tubes 7*b* that connect to the return fluid reservoir(s) 2 via pump 6*b* which provide the suction to motivate the return fluids which comprise a mixture of excess supply fluids and ambient gases 10 to the return fluid reservoir 2.

When in a plating or anodizing mode or employing processes requiring the supply of current, electrode 3*a* is electrically connected to one terminal of the activated power supply 5. Substrate 8 is electrically connected to the other terminal of the activated power supply 5.

The tool is then placed in a position, touching the surface to be treated 8 and moved relative to the surface, by hand or with help of automation, over the substrate 8, thereby completing an electrical circuit from the power supply 5 through the electrode 3*a* and fluid in the porous pad 4 to the substrate 8 and back to the power supply 5. Pad 4 may be structure of fibers (e.g., non-woven) in a three-dimensional web, see, for example, U.S. Pat. No. 2,958,593 incorporated herein by this reference. Sponges, scouring pads, and the like, may also serve as the pad.

Fluid is supplied from a reservoir 1 such as a bottle, via pump 6*a* to the plumbed fluid supply system of channels within the integrated electrode 3*a*. Within the electrode, a system or systems of channels distribute the supply fluid to a matrix of fluid supply ports 3*b* on the electrode face or faces which are adjacent and connected to a porous media pad 4. The supply fluid distributes through the porous media pad 4 and wets the substrate 8 enough for the electrochemical treatment. Excess fluid is simultaneously collected and sucked through the porous pad 4 into a separate system of fluid return channels which are in turn plumbed to return tubing connecting to a return fluid reservoir 2 or bottle via a pump 6*b*. The balance of fluid supply and fluid return may be controlled by the controller 6*c*. The integrated electrode structure 3*a* is connected via a power supply 5 to the substrate to be treated 8, in this way the electrical circuit can be completed and the supply fluid or electrolyte can then react and electroplate onto the substrate being treated 8 or indeed anodize the substrate to be treated 8 if the polarity of the power supply 5 is changed. This whole system can indeed be operated without the power supply 5 if for example, the system is used for a rinsing step.

Figure 2:
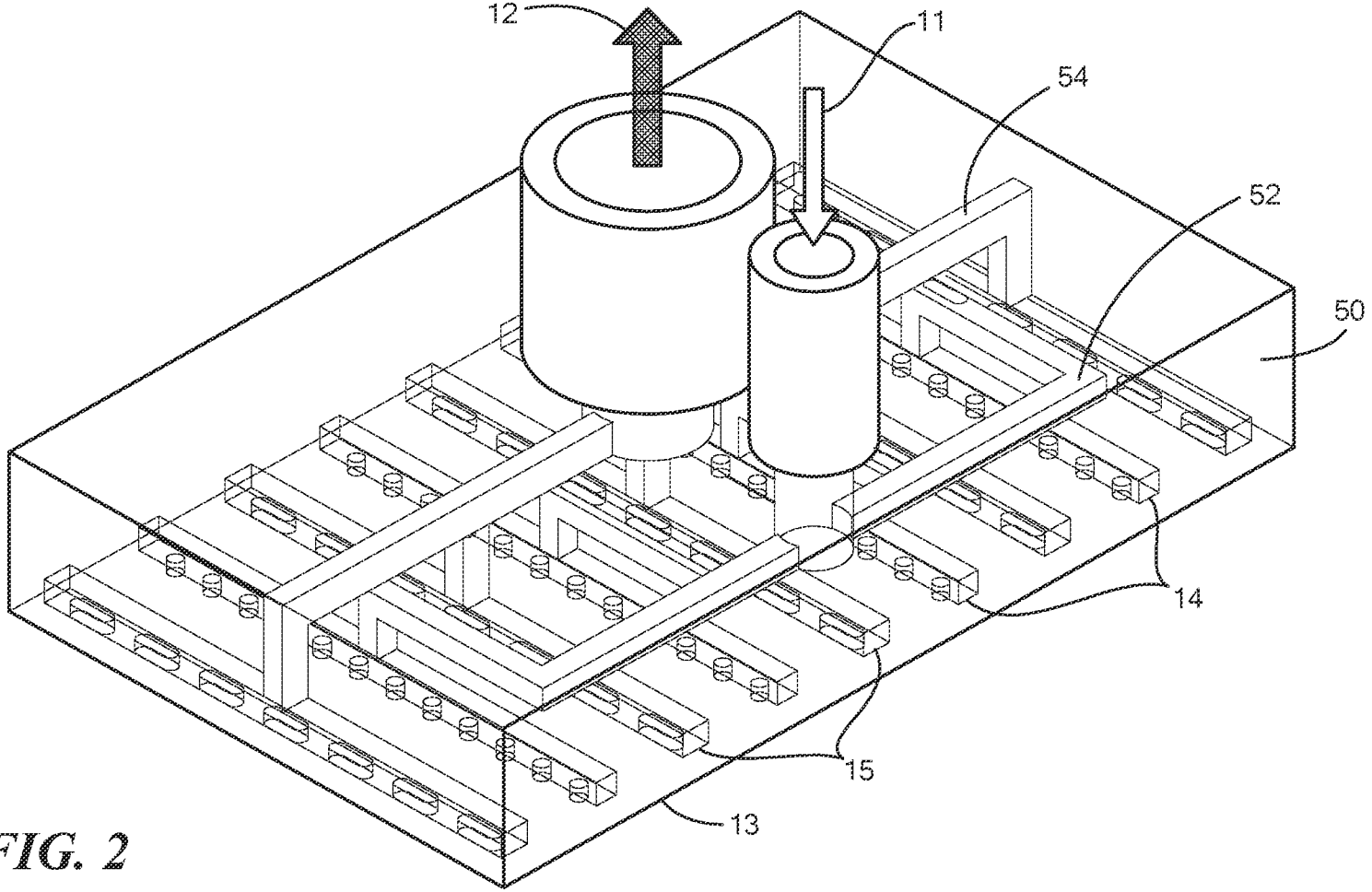
FIG. 2 is a schematic view of one version of the electrode with an integrated single supply channel system and an integrated single return flow channel system.
Figure 3:
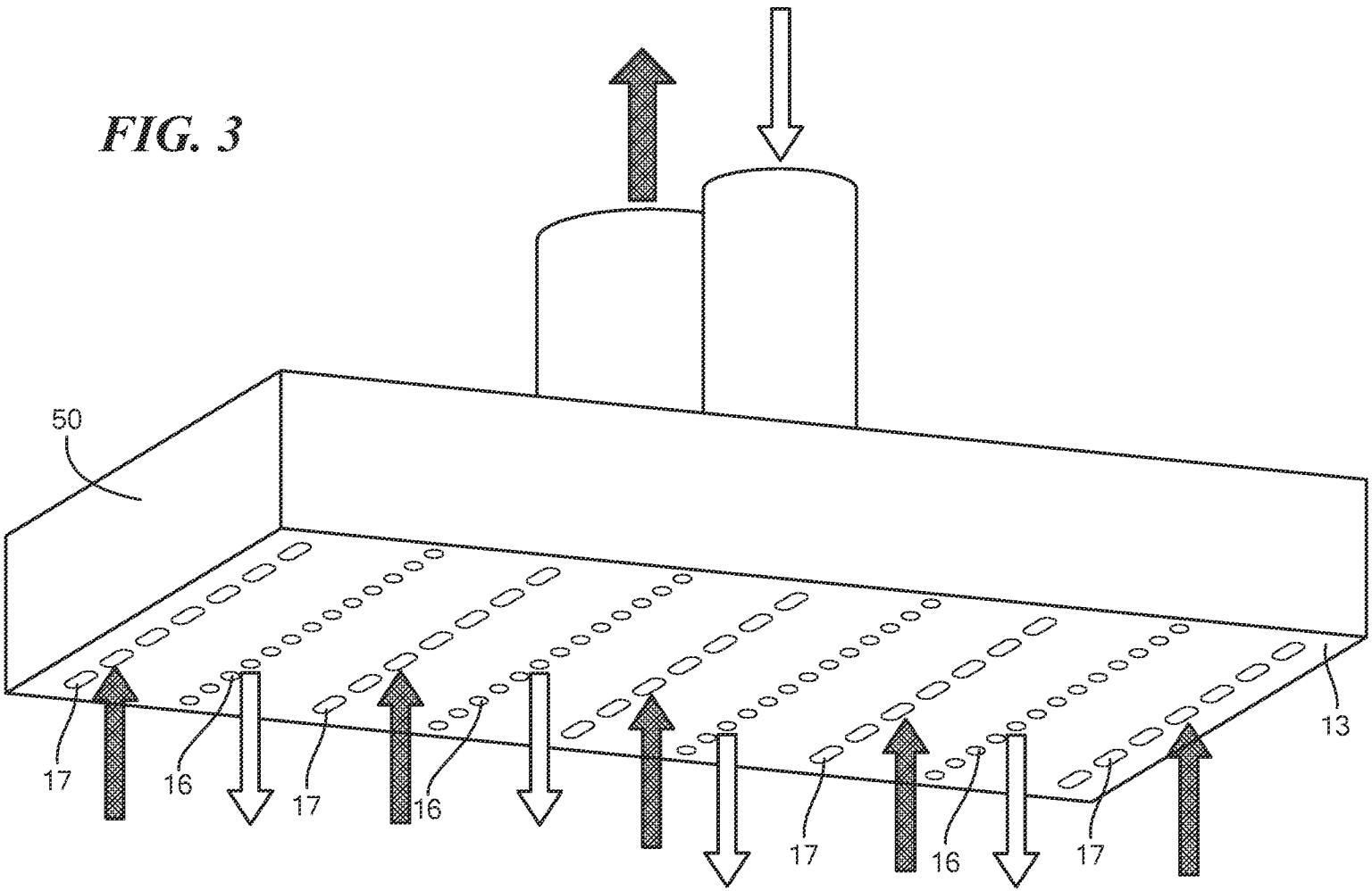
FIG. 3 is a view showing rectangular return flow ports and circular supply flow ports shown in electrode face.

FIGS. 2-3 show examples of the fluid supply connection 11 and fluid return connection 12 in housing 50 to an integrated electrode 13 with a fluid supply channel system 14 and a fluid return channel system 15. Electrode 13 includes fluid supply ports 16 and the fluid return or collection ports 17 on the bottom face of the integrated electrode structure. The fluid supply manifold includes linear channels 14 connect to duct 52 and the fluid return manifold includes linear channels 15 connected to duct 54. Channels 14 and 15 alternate with each other.

Figure 4:
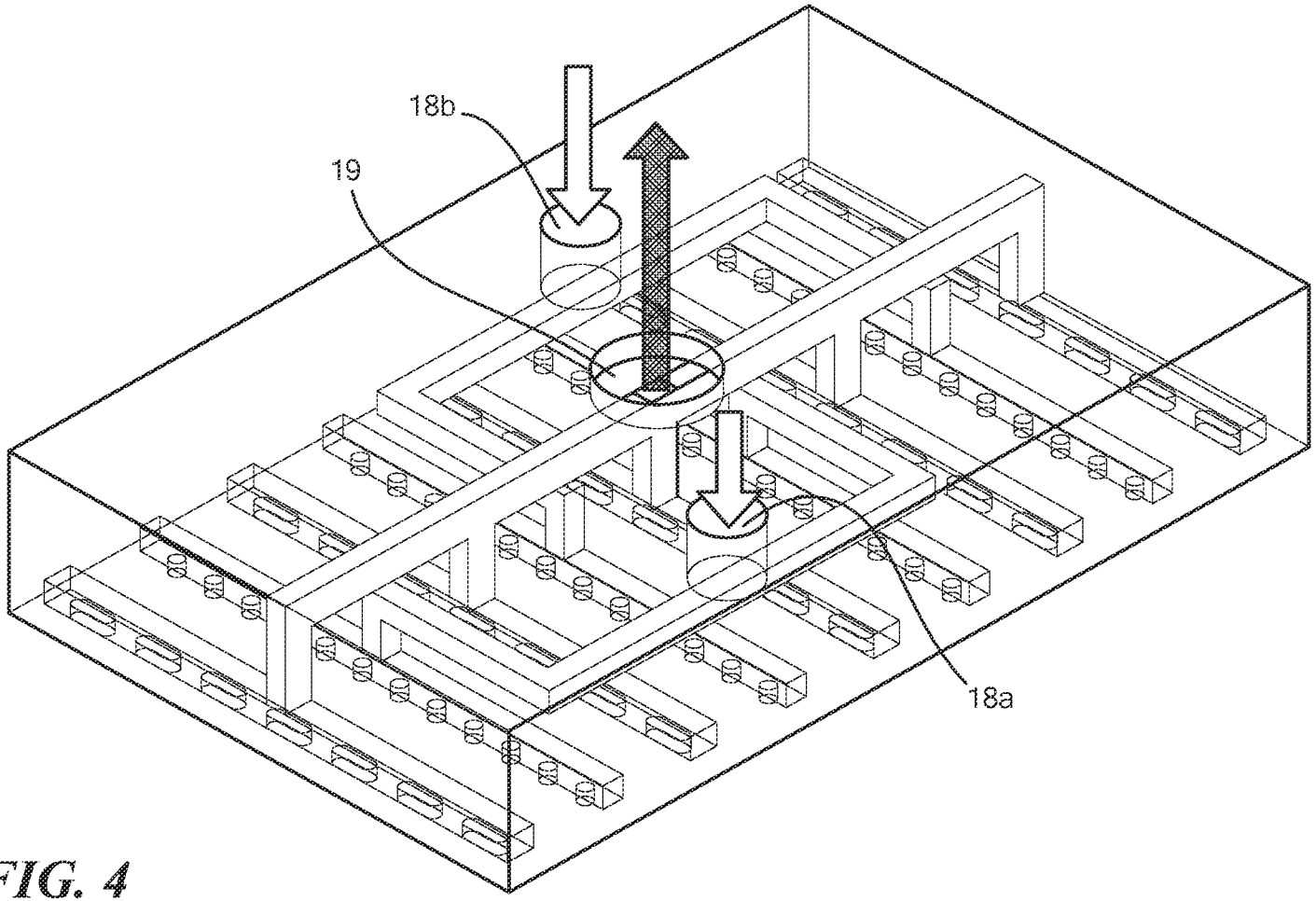
FIG. 4 is a schematic view of an alternative version of the electrode.

FIG. 4 shows an alternative electrode design with two separate fluid supply channel systems 18*a* and 18*b* as well as a separate fluid return channel system 19.

Figure 5:
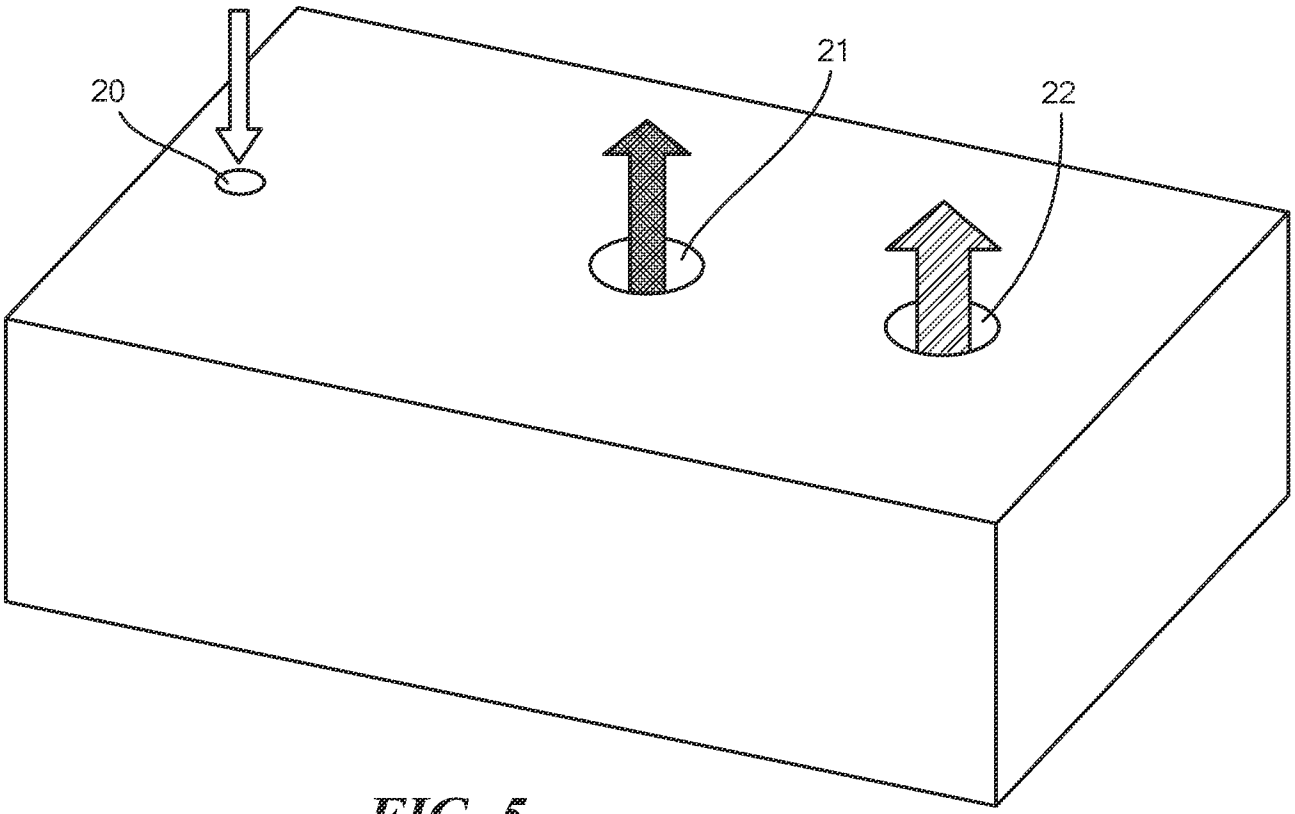
FIG. 5 is a schematic view of an integrated electrode design with one supply flow channel system, one return flow (exhausting) channel system and one peripheral channel system.
Figure 6:
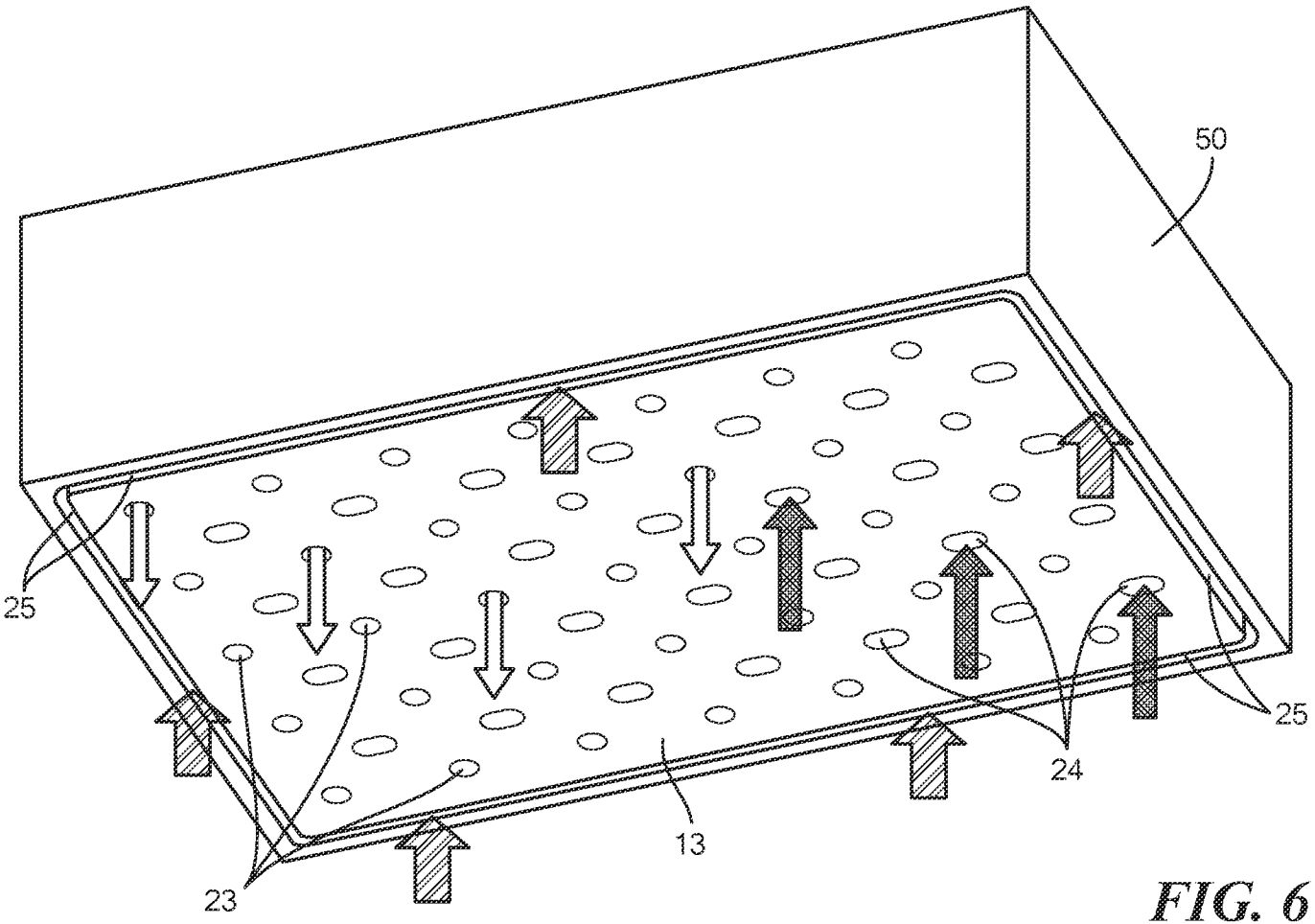
FIG. 6 is a schematic view of FIG. 5, seen from the opposite side.

FIG. 5 shows a particular embodiment with three separate fluid supply channel systems integrated into the electrode. The fluid supply 20 is connected to one channel system, the fluid return 21 is drawn from another channel system and there is an additional return 22 drawn or sucked from a peripheral slot 25, FIG. 6. Three separate fluid flow channel systems can be integrated into the electrode. A pumping system motivates supply fluid to the supply fluid channel system 23. In this particular design, there are two fluid return systems, one system connected to a pump in order to collect the flow from a matrix of ports 24 on the face of the electrode and another, peripheral system 25 connected to another pump allowing collection of fluid from the periphery. Alternatively, the peripheral system could be operated in reverse, to supply another inlet fluid or an inerting gas.

Figure 7:
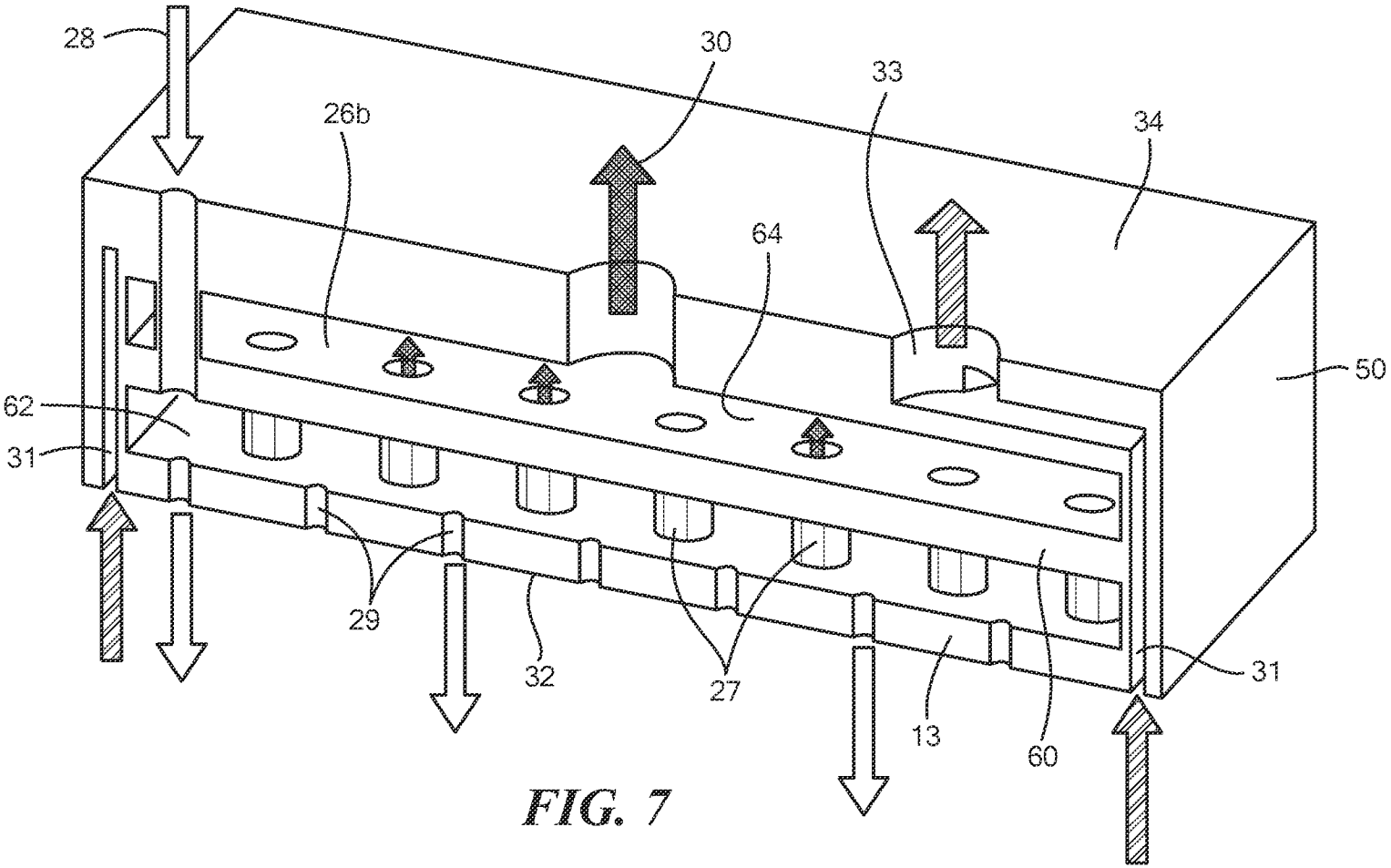
FIG. 7 is a schematic view of an integrated electrode design with one supply flow channel system, one return flow (exhausting) channel system and one peripheral channel system.

FIG. 7 shows a section view illustrating the detail of the integrated electrode design introduced and presented in FIG. 5. Using a construction of a system of plenums 26*a*, 26*b* and hollow pillars or conduits 27 it is possible to manufacturer (3D additive techniques for example) a structure that can keep the fluid channel systems separate. This view shows in particular how the supply fluid delivered though conduit 28 flows into the lower plenum 26*a* and out of the fluid supply ports 29 to the porous media (not shown).

Housing 50 includes internal wall 60 separating the housing into treatment fluid supply chamber 62 and fluid return chamber 64. The fluid supply manifold thus includes chamber 62 and conduit 28 through wall 60 and extending out of housing 50. Fluid in chamber 62 flows through fluid supply ports 29. The return flow manifold includes chamber 64 and conduits 27 extending through wall 60 to the electrode return ports 35, FIG. 8.

Furthermore, it is possible to see another return flow system where the fluid can be collected from a periphery slot 31 on the electrode active face 32 and directed through a separate channel system to a further collection point 33, in this case, on the top (or back) face of the electrode 34.

Figure 8:
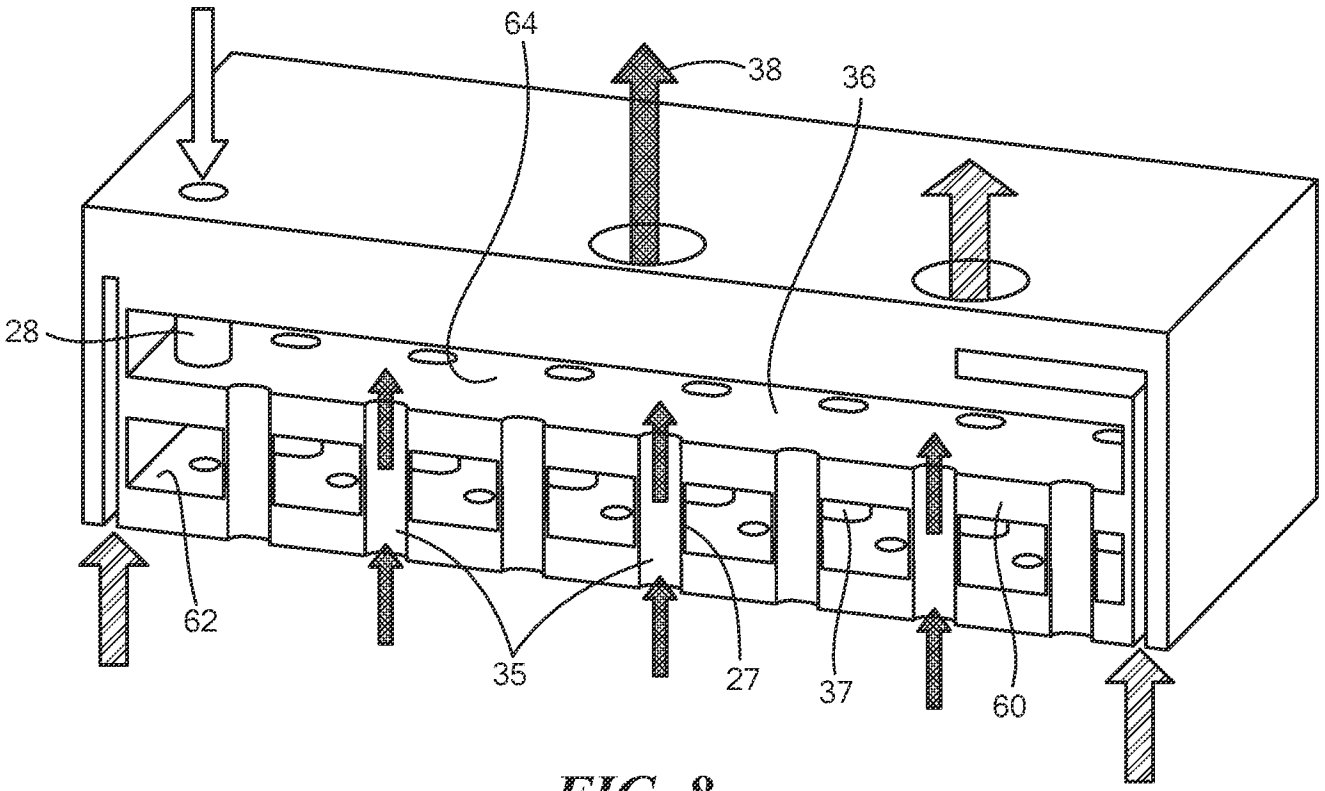
FIG. 8 is a schematic view of an integrated electrode design with one supply flow channel system, one return flow (exhausting) channel system and one peripheral channel system.

FIG. 8, another view of FIG. 5, shows in particular how the return fluid is collected from the porous media (not shown) via a system of ports 35 into a separate, upper plenum 36, via hollow pillars 37. This view shows in particular how the fluid collected from the porous media (not shown) is directed to an upper plenum and then collected through the fluid return collection 38 and directed to the pump.

Figure 9:
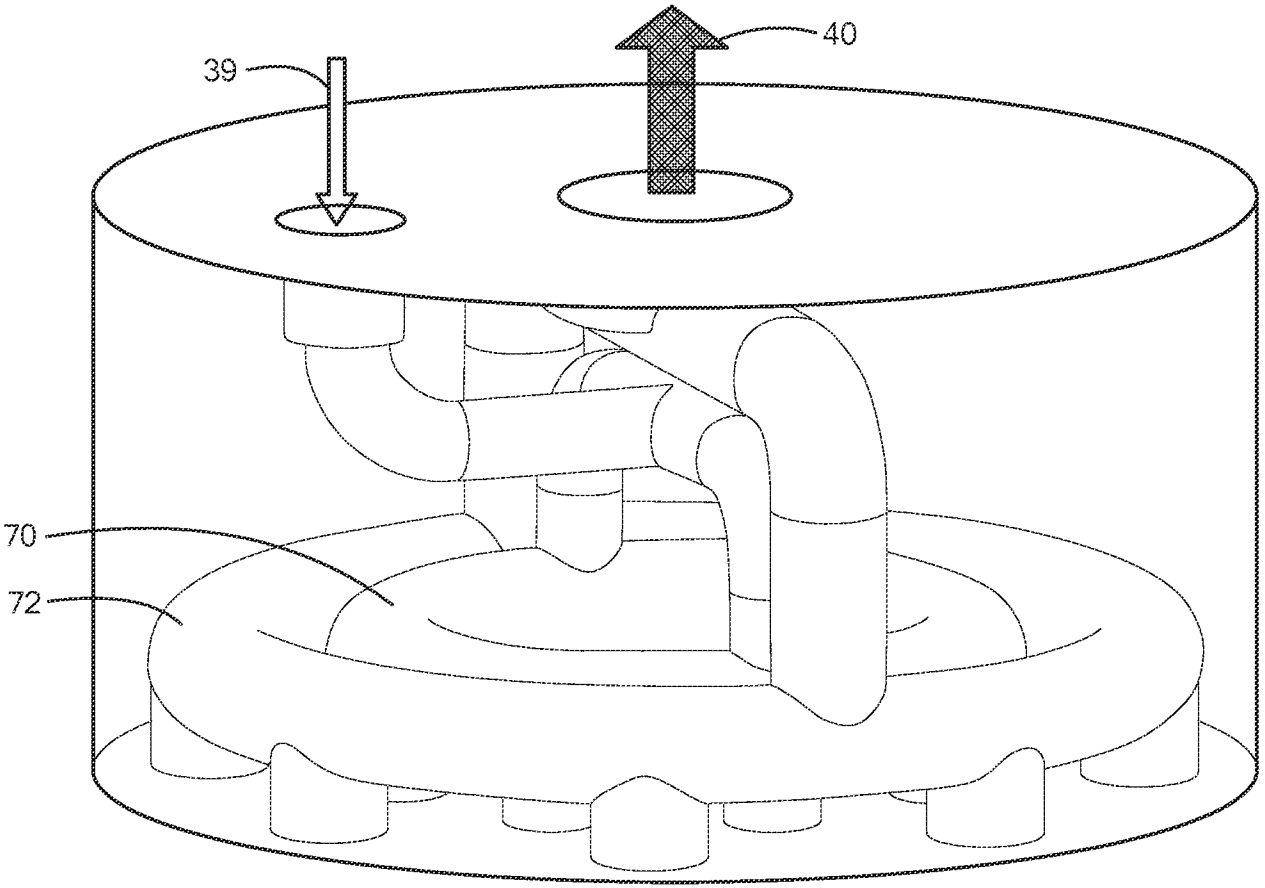
FIG. 9 is a schematic view of an electrode design showing integrated concentric supply flow and return flow channel systems.

FIG. 9 shows an alternative structure for the manifolds. In this example the supply fluid 39 flows through a plenum to an inner circular arrangement of ports towards the porous media (not shown) and the return fluid 40 is collected from an outer, circular plenum 72 collection of ports arranged concentric to the supply fluid ports. Similarly, serpentine and spiral arrangements can be constructed. Plenums 70 and 72 are nested as shown.

Figure 10:
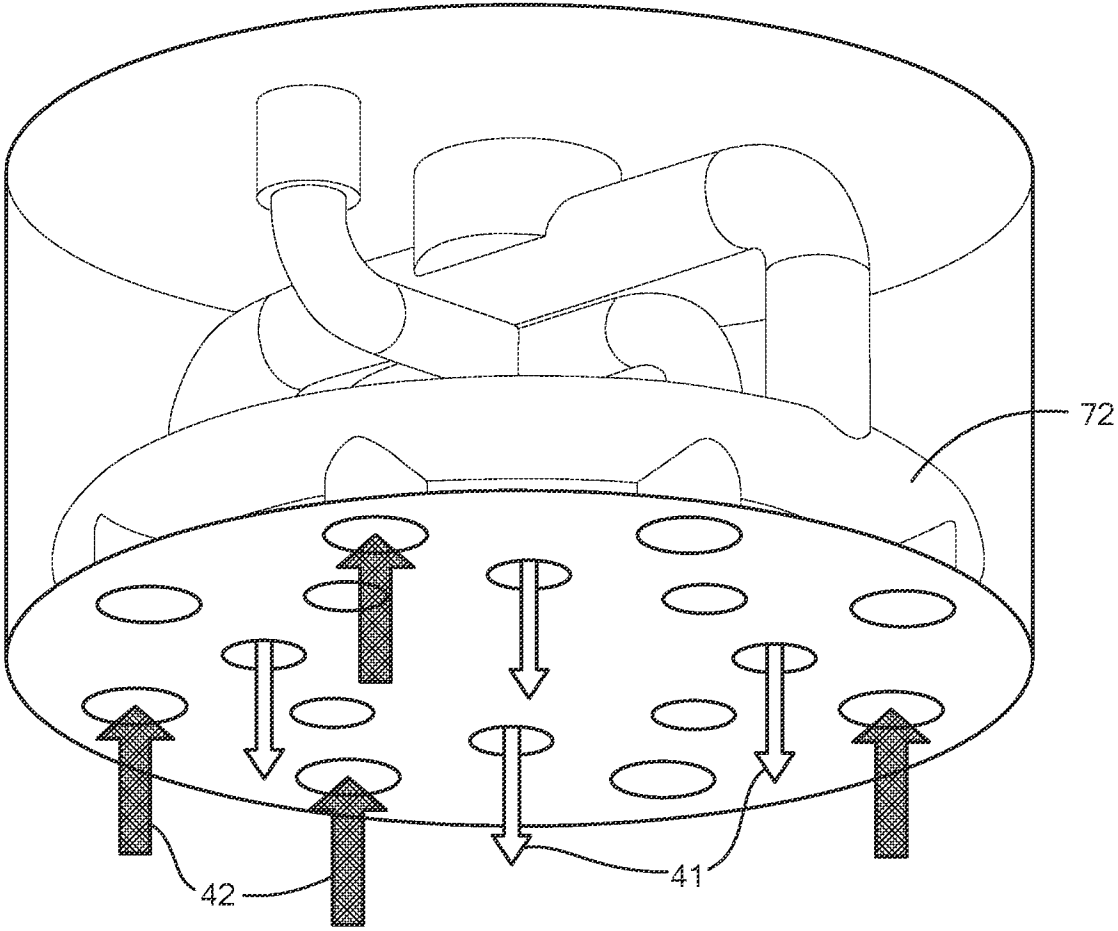
FIG. 10 is another schematic view of an embodiment using concentric supply flow and return flow channel systems.

FIG. 10 shows another view of FIG. 9, where the supply fluid 41 is directed to the porous media (not shown) through an inner circular arrangement of ports and the return fluid 42 is collected through a circular arrangement of ports arranged concentric to the supply fluid ports.

Figure 11:
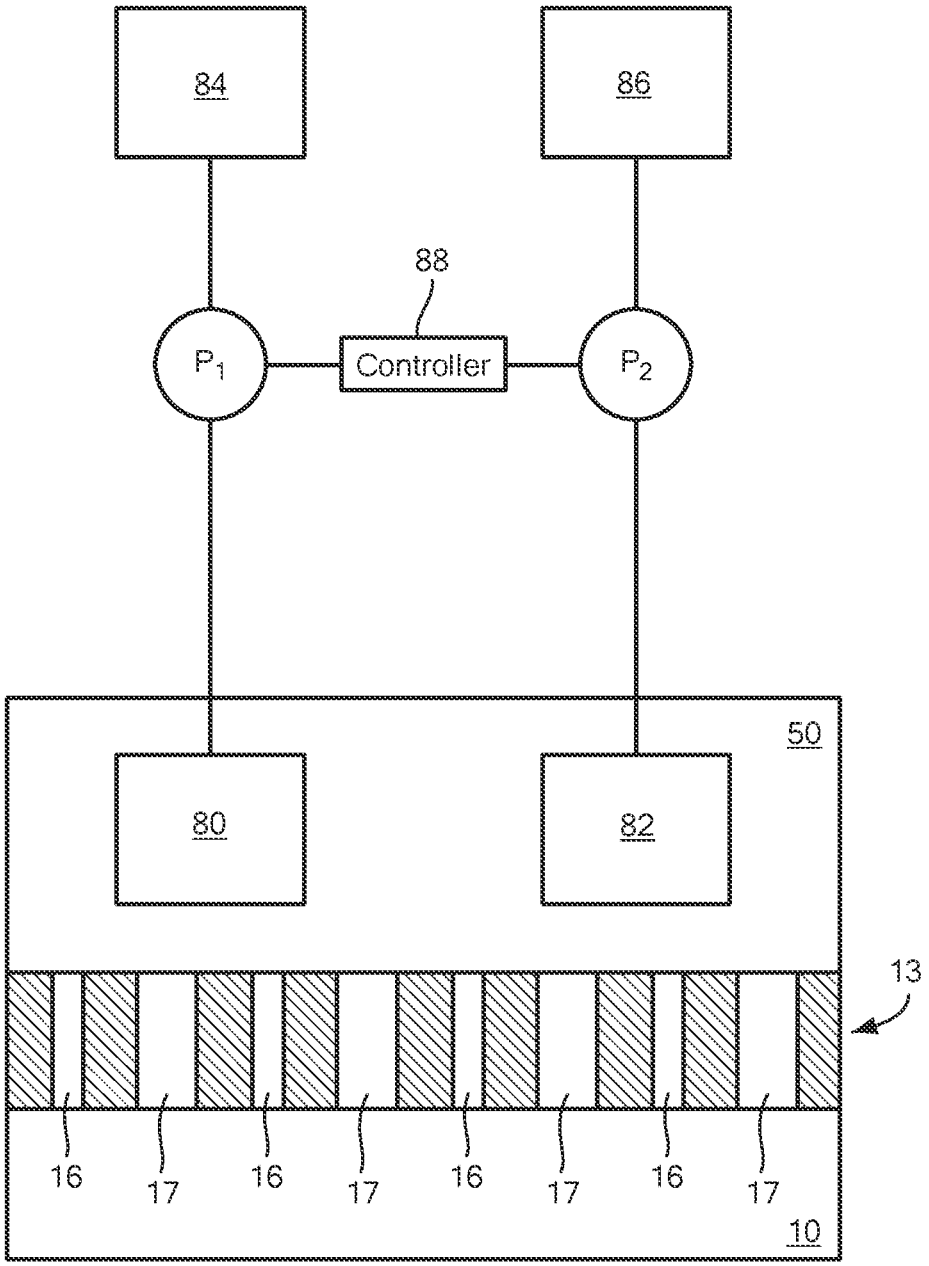
FIG. 11 is a block diagram depicting the primary components associated with an example of a treatment system and method.

In one embodiment, FIG. 11, an electrochemical treatment system housing 50, includes a treatment fluid supply manifold 80 and a fluid return manifold 82 and a bottom electrode section 13. There are a plurality of treatment fluid supply ports 16 in the bottom electrode section connected to the treatment fluid supply manifold 80 and a plurality of fluid return ports 17 in the bottom electrode section proximate the treatment fluid supply ports and connected to the fluid return manifold 82. A porous pad 10 is coupled to the bottom electrode section 13 for contacting a substrate to be treated and receiving the treatment fluid via the plurality of treatment fluid supply ports while the plurality of fluid return ports remove spent and excess treatment fluid and gases from the substrate and the porous pad.

A treatment fluid reservoir 84 coupled to the treatment fluid supply manifold 80 via a first pump $P_1$. A return fluid reservoir 86 is coupled to the fluid return manifold 82 via a second pump $P_2$. Controller 88 may be programmed to automatically operate the first pump Pt and the second pump $P_2$ at rates which limit leakage of treatment fluid from the pad 10 while urging the treatment fluid to fully disperse throughout the pad 10.

A method of electrochemically treating a substrate features contacting the substrate with an electrode 13 fitted with a porous pad 10. A treatment fluid is driven through supply ports 16 in the electrode and to multiple locations of the porous pad. Spent and excess treatment fluid and gases are driven from multiple locations of the porous pad through return ports 17 in electrode 13 at a rate which limits electrolyte leakage from the pad 10 while urging the treatment fluid to fully disperse throughout the extent of the pad.

There may be a ratio of one supply port for several surrounding return ports, or supply and return tubes of different diameters, or pumps that feed electrolyte and exhaust electrolyte and air at different rates. The controller can be programmed to operate the pumps based on several factors such as the number and size and spacing of the supply ports and return ports, the size, material, and the porosity of the pad, and the viscosity of the treatment fluid (e.g., an electrolyte, rinsing water, ionic salts, and the like).

Figure 12:
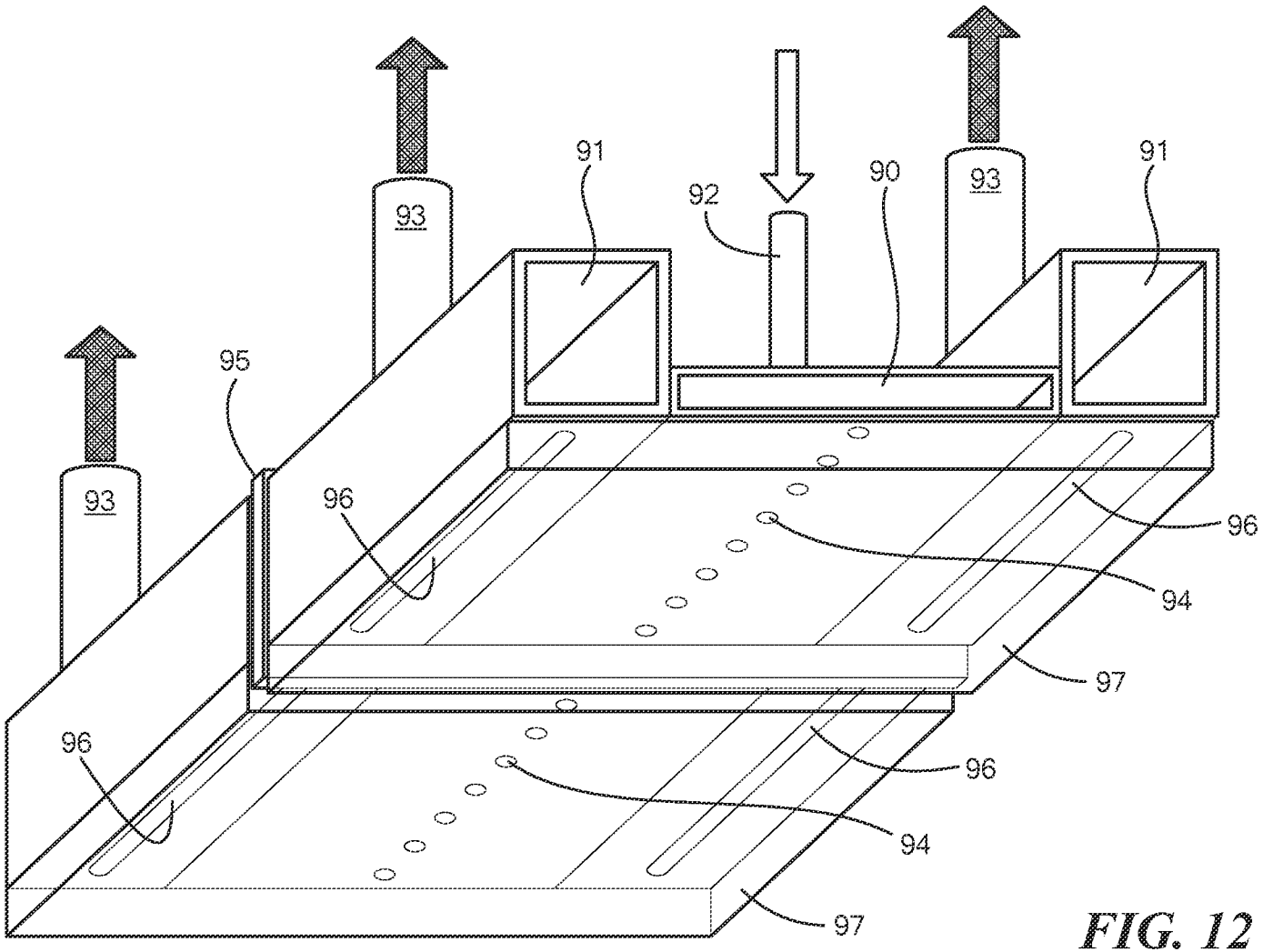
FIG. 12 is a schematic showing the structure and cross section of an embodiment for processing long objects, incorporating a series of cells, each comprising a series of holes or slots as electrolyte supply ports and return flow ports. Such a structure could be manufactured from rigid or flexible materials to accommodate flat or curved surfaces.

FIG. 12 shows another design intended for coating large areas. This design comprises one or more cells or sections that may be separated by intercell boundaries 95 and may be operated independently or simultaneously. The fluid is pumped into the electrode 90 via the supply tube 92. It is dispersed into the electrolyte pad 97 via an array of supply ports 94, and air plus electrolyte is pumped out via return slots or holes 96 connected to the return manifold 91 and from there to fluid return tubes 93. For coating flat areas, the cells may be flat and rigid, while for curved surfaces the cells may be constructed of flexible material, for example, the electrode made from wire, fiber, mesh, conductive polymer, or other flexible, electrical conductors.

A typical anodizing treatment using an electrolyte may employ a pad 4" by 4" which can be moved over a part to be treated manually, robotically (e.g., using a robot arm), or using a CNC machine or, the pad and electrolyte can be held stationary and the part rotated or moved relative to the pad and electrolyte.

The balance of the fluid supply flows and fluid return flows can be important to the operation of the non-drip system. The balance of the fluid flows may depend on many parameters, such as the supply flow rates, the return flow rates, viscosity of the fluids, temperature, porosity of the porous media, capillarity forces, pressure drop through the flow channels, the proximate arrangement of the supply flow and return flow ports on the electrode face, and the precise geometry and routes of the fluid flow channel systems within the electrode. Testing the effect of each of the parameters mentioned above with physical prototypes would be time consuming, and there is no guarantee that an appropriate design can be achieve with such a "hit and miss", i.e. Edisonian approach. A more effective engineering procedure is to create a virtual prototype using Computational Fluid Dynamics (CFD) where one can quantitatively assess the impact of each of these parameters on the final design. Therefore, one can size and optimize the precise channel system dimensions and routing in order to calculate the pump rates required for the operational balance of supply flows and return flows to eliminate drippage. Unfortunately, most of the CFD models needed for these complex phenomena do not take into consideration the full set of forces, for example the capillary force. There may be different combinations of parameters according to the process. For example, the optimum geometry and fluid flow settings for an anodizing process may differ from the optimum geometry and settings for a plating process. However, these optimum parameters can be calculated, upfront with CFD techniques. The electrode can then be manufactured and a pump controller programmed with the necessary logic for that particular process.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. An out of tank electrochemical treatment system comprising:

one or more treatment fluid reservoirs; and a housing including:

a treatment fluid supply manifold connected to the one or more treatment fluid reservoirs and including treatment fluid supply channels, a return manifold connected to the one or more treatment fluid reservoirs and including treatment fluid return channels, an electrode section connected to the treatment fluid supply manifold, a porous pad coupled to the electrode section and configured to contact and wet the substrate with treatment fluid, a plurality of treatment fluid supply ports connected to the treatment fluid supply channels of the treatment fluid supply manifold and configured to feed treatment fluid through or across the electrode section and distribute treatment fluid through the porous pad, and a plurality of return suction ports proximate the treatment fluid supply ports and connected to the treatment fluid return channels of the return manifold and configured to remove spent and excess treatment fluid and ambient gases from the substrate, the surrounding air, and the porous pad and deliver said spent and excess treatment fluid and ambient gases to the one or more treatment fluid reservoirs via the return manifold; and a peripheral treatment fluid channel about the porous pad and connected to a channel of the return manifold to deliver said spent and excess treatment fluid and ambient gases to the one or more treatment fluid reservoirs via the return manifold.

2. The system of claim 1 in which the treatment fluid is an electrolyte.

3. The system of claim 1 in which a treatment fluid reservoir is connected to the treatment fluid supply manifold via a first pump.

4. The system of claim 1 in which a treatment fluid reservoir is coupled to the return manifold via a second pump.

5. The system of claim 4 further including a controller automatically operating the first pump and the second pump at rates which fully disperse the treatment fluid throughout the porous pad while preventing leakage of treatment fluid from the pad and balancing treatment fluid supplied to the pad with treatment fluid and ambient gas removed via the second pump through the return suction ports and the return manifold.

6. The system of claim 1 further including a power supply electrically interconnected between the electrode section and the substrate.

7. The system of claim 1 in which the treatment fluid supply manifold includes linear channels each over an array of treatment fluid supply ports and the return manifold includes linear channels each over an array of suction ports.

8. The system of claim 7 in which the treatment fluid supply manifold linear channels alternate with the return manifold linear channels.

9. The system of claim 7 in which the array of treatment fluid supply ports is a 1 by n array where n is greater than 1.

10. The system of claim 7 in which the suction ports are in a 1 by n array where n is greater than 1.

11. The system of claim 7 in which the treatment fluid supply manifold further includes a duct interconnecting the linear channels over the array of treatment fluid supply ports.

12. The system of claim 7 in which the return manifold further includes a duct interconnecting the linear channels over the array of suction ports.

13. The system of claim 1 in which the housing includes an internal wall separating the housing into a treatment fluid supply chamber and a return treatment fluid chamber.

14. The system of claim 13 in which the treatment fluid supply chamber is between the internal wall and the electrode section, the treatment fluid supply ports in communication with the treatment fluid supply chamber.

15. The system of claim 14 in which the fluid supply manifold includes the treatment fluid supply chamber and a conduit extending from the treatment fluid supply chamber through the internal wall.

16. The system of claim 14 in which the return manifold includes the fluid return chamber and conduits extending through the internal wall to the suction ports in the electrode section.

17. The system of claim 1 in which the treatment fluid supply manifold includes a first plenum and the treatment fluid return manifold includes a second plenum nestled with the first plenum.

18. The system of claim 1 in which the porous pad includes woven or non-woven fibers in a three-dimensional web.

19. The system of claim 1 in which there are first and second treatment fluid manifolds each connected to a sub plurality of treatment fluid supply ports and each connected via a pump to a different treatment fluid reservoir.

20. The system of claim 1 in which there are one or more treatment cells, constructed so that each treatment cell may be operated independently, or together with any other treatment cell, each treatment cell comprising a treatment fluid supply manifold, a return manifold, an electrode, and a plurality of treatment fluid supply ports and suction ports.

21. The system of claim 20 in which the electrode is flexible, allowing the system to maintain contact with a curved surface.

22. The system of claim 21 in which the electrode is made of wires, grids, meshes, fibers, conductive polymers, or other flexible materials.

23. The system of claim 1 in which a treatment fluid reservoir is coupled to the treatment fluid supply manifold via a first pump.

24. The system of claim 23 in which a fluid treatment reservoir is coupled to the return manifold via a second pump.

25. The system of claim 24 further including a controller automatically operating the first pump and the second pump at rates which fully disperse the treatment fluid throughout the porous pad while preventing leakage of treatment fluid from the pad by balancing treatment fluid supplied to the pad against treatment fluid and ambient gas removed via the second pump through the treatment fluid return suction ports and the treatment fluid return manifold.

26. The system of claim 1 in which there is a treatment fluid supply reservoir connected to the treatment fluid supply manifold and a separate treatment fluid return reservoir connected to the return manifold.

27. An out of tank electrochemical treatment system comprising:

an electrode section;

a porous pad coupled to the electrode section and configured to contact a substrate to be treated;

a treatment fluid supply manifold connected to a treatment fluid reservoir and including treatment fluid supply channels;

a return manifold connected to a treatment fluid reservoir and including treatment fluid return channels;

a plurality of treatment fluid supply ports in fluid communication with the treatment fluid supply channels of the treatment fluid supply manifold that distributes treatment fluid from a treatment fluid reservoir through the porous pad;

a plurality of suction ports proximate the treatment fluid supply ports and connected to the treatment fluid channels of the return manifold and configured to remove spent and excess treatment fluid and ambient gases from the substrate, the surrounding air, and the porous pad and deliver said spent and excess treatment fluid and ambient gases to a treatment reservoir via the return manifold; and a peripheral treatment fluid return channel about the porous pad and connected to a channel of the return manifold to deliver said spent and excess treatment fluid and ambient gases to the return treatment fluid reservoir via the return manifold.

28. The system of claim 27 in which the treatment fluid is an electrolyte.

29. The system of claim 27 in which the treatment fluid supply manifold includes linear channels each over an array of treatment fluid supply ports and the return manifold includes linear channels each over an array of suction ports.

30. The system of claim 29 in which the treatment fluid supply manifold linear channels alternate with the return manifold linear channels.

31. The system of claim 29 in which the array of treatment fluid supply ports is a 1 by n array where n is greater than 1.

32. The system of claim 29 in which the suction ports are in a 1 by n array where n is greater than 1.

33. The system of claim 29 in which the treatment fluid supply manifold further includes a duct interconnecting the treatment fluid supply manifold linear channels over the array of treatment fluid supply ports.

34. The system of claim 29 in which the return manifold further includes a duct interconnecting the linear channels over the array of suction ports.

35. The system of claim 27 further including a wall separating the housing into a treatment fluid supply chamber and a treatment fluid return chamber.

36. The system of claim 35 in which the treatment fluid supply chamber is between the wall and the electrode section, the treatment fluid supply ports in communication with the treatment fluid supply chamber.

37. The system of claim 36 in which the treatment fluid supply manifold includes the treatment fluid supply chamber and a conduit extending from the treatment fluid supply chamber through the wall.

38. The system of claim 36 in which the return manifold includes the treatment fluid return chamber and conduits extending through the wall to the suction ports.

39. The system of claim 27 in which the treatment fluid supply manifold includes a first plenum and the return manifold includes a second plenum nestled with the first plenum.

40. The system of claim 27 in which the porous pad includes woven or non-woven fibers in a three-dimensional web.

41. The system of claim 27 in which there are first and second treatment fluid manifolds each connected to a sub plurality of treatment fluid supply ports and each connected via a pump to a different treatment fluid reservoir.

42. The system of claim 27 in which there are one or more treatment cells, constructed so that each treatment cell may be operated independently, or together with any other treatment cell, each treatment cell comprising a treatment fluid supply manifold, a return manifold, an electrode, and a plurality of treatment fluid supply ports and suction ports.

43. The system of claim 42 in which the electrode is flexible, allowing the system to maintain contact with a curved surface.

44. The system of claim 43 in which the electrode is made of wires, grids, meshes, fibers, conductive polymers, or other flexible materials.

45. The system of claim 27 in which there is a treatment fluid supply reservoir connected to the treatment fluid supply manifold and a separate treatment fluid return reservoir connected to the return manifold.

* * * * *